US011072492B2

(12) United States Patent
Buck

(10) Patent No.: US 11,072,492 B2
(45) Date of Patent: Jul. 27, 2021

(54) BIN ASSEMBLY WITH HORIZONTAL, CONVEX APERTURE FOR INSTALLING A BAG

(71) Applicant: TBUCK GLOBAL LLC, Pasadena, CA (US)

(72) Inventor: Thomas K. Buck, Pasadena, CA (US)

(73) Assignee: TBUCK GLOBAL LLC, Pasadena, CA (US)

( * ) Notice: Subject to any disclaimer, the term of this patent is extended or adjusted under 35 U.S.C. 154(b) by 108 days.

(21) Appl. No.: 16/559,128

(22) Filed: Sep. 3, 2019

(65) Prior Publication Data

US 2020/0087062 A1 Mar. 19, 2020

Related U.S. Application Data

(60) Provisional application No. 62/730,868, filed on Sep. 13, 2018.

(51) Int. Cl.

| | |
|---|---|
| ***B65F 1/04*** | (2006.01) |
| ***B65F 1/16*** | (2006.01) |
| ***B65F 1/06*** | (2006.01) |

(52) U.S. Cl.

CPC ..... *B65F 1/1646* (2013.01); *B65F 1/06* (2013.01)

(58) Field of Classification Search

CPC .. B65F 1/06; B65F 1/1646; B65F 1/08; B65F 1/1426; B65F 1/16; B65D 25/16; B65D 43/0212

USPC ..... 220/200, 908, 495.06, 495.1, 908.1, 220/495.08, 495.11

See application file for complete search history.

(56) References Cited

U.S. PATENT DOCUMENTS

| | | | | |
|---|---|---|---|---|
| 4,589,570 | A | 5/1986 | Auten | |
| 4,765,579 | A * | 8/1988 | Robbins, III | B65F 1/06 220/495.04 |
| 5,054,724 | A | 10/1991 | Hutcheson | |
| 2008/0116205 | A1 | 5/2008 | Forest | |
| 2015/0076152 | A1 | 3/2015 | Buck | |
| 2017/0313503 | A1 * | 11/2017 | Busch | B65F 1/1468 |

FOREIGN PATENT DOCUMENTS

| | | | | |
|---|---|---|---|---|
| JP | 2009073653 | * | 9/2007 | B65F 1/06 |
| WO | WO 2017/081474 A2 | | 5/2017 | |

OTHER PUBLICATIONS

International Search Report and Written Opinion for Application No. PCT/US2019/049352, dated Dec. 20, 2019, 10 pages.

International Preliminary Report on Patentability for Application No. PCT/US2019/049352, dated Dec. 11, 2020, 5 pages.

* cited by examiner

*Primary Examiner* — James N Smalley
*Assistant Examiner* — Elizabeth J Volz
(74) *Attorney, Agent, or Firm* — Lewis Roca Rothgerber Christie LLP

(57) ABSTRACT

A bin assembly including a receptacle or a receptacle-crown. The receptacle or receptacle-crown includes at least one wall defining an interior space, a mouth in communication with the interior space that is defined by an upper end of the at least one wall, a rim extending outward and downward from the mouth that includes at least one horizontally convex portion below the mouth, and an aperture in the at least one horizontally convex portion of the rim configured to receive an edge portion of a liner.

16 Claims, 6 Drawing Sheets

BIN ASSEMBLY WITH HORIZONTAL, CONVEX APERTURE FOR INSTALLING A BAG

CROSS-REFERENCE TO RELATED APPLICATION

This application claims priority to and the benefit of U.S. Provisional Application No. 62/730,868, filed Sep. 13, 2018, the entire contents of which are incorporated herein by reference.

BACKGROUND

1. Field

The present disclosure relates generally to bins and bin assemblies.

2. Description of the Related Art

Receptacles are commonly utilized to store a variety of different types of items, such as, for instance, food items, literature, office supplies, or refuse. Depending on the types of items that the receptacle is designed to contain, the receptacle may be used with a bag or a liner to protect the contents of the receptacle and/or to protect the receptacle against damage, dirtying, or staining. Related art receptacles may also include a lid or a ring to secure the bag or liner to the remainder of the receptacle.

However, related art receptacles are designed to accommodate only a particular size of bag or liner. For instance, when an oversized bag or liner is used with related art receptacles, an excess of the portion of the bag or liner around the opening (i.e., the skirt of the bag or liner) may remain visible even when the lid or ring is secured to the remainder of the receptacle because these related art receptacles are not configured to accommodate or otherwise conceal the excess of the bag or liner. Accordingly, the use of an oversized bag or liner with a related art receptacle may create an unsightly condition. Additionally, with related art receptacles, it may be difficult or impossible to secure an oversized bag or liner with the lid or the ring.

SUMMARY

The present disclosure relates to various embodiments of a bin assembly. In one embodiment, the bin assembly includes a receptacle or a receptacle-crown. The receptacle or the receptacle-crown includes at least one wall defining an interior space, a mouth in communication with the interior space that is defined by an upper end of the at least one wall, a rim extending outward and downward from the mouth that includes at least one horizontally convex portion below the mouth, and an aperture in the at least one horizontally convex portion of the rim that is configured to receive an edge portion of a liner.

The aperture may be elongated horizontally.

The aperture may be closed at opposite ends.

The bin assembly may also include a channel defined between a lower surface of the rim and an outer surface of the at least one wall, and the aperture my open to the channel.

The aperture may not be in communication with the interior space.

The bin assembly may also include a ring or a lid configured to fit over the rim of the receptacle or the receptacle-crown.

The rim may include a corner, and the at least one horizontally convex portion may be at the corner.

The rim may include a first straight side at a first end of the corner, and a second straight side at a second end of the corner opposite the first end. The aperture may extend entirely around the corner and into portions of the first and second straight sides.

The rim may be rectangular, annular, oval, or any other suitable shape.

The rim may include a lip, a fall extending downward from a lower end of the lip, and a guide extending outward from a lower end of the fall.

The aperture may be in a portion of the fall.

The guide may be adjacent to the aperture.

The rim may include a lip, a fall extending downward from a lower end of the lip, and at least a portion of a trough extending outward and downward from a lower end of the fall. The aperture may be in a portion of the fall.

The rim may include a series of convex apertures, and at least a portion of a trough.

The bin assembly may include the receptacle, the receptacle may include a base, and the at least one wall may extend upward from the base.

The bin assembly may include the receptacle-crown.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

The features and advantages of embodiments of the present disclosure will be better understood by reference to the following detailed description when considered in conjunction with the accompanying figures. In the figures, like reference numerals are used throughout the figures to reference like features and components. The figures are not necessarily drawn to scale.

DETAILED DESCRIPTION

The present disclosure is directed to various embodiments of a bin assembly comprising at least two components and permitting the installation of a bag. The first component is either a receptacle or a receptacle-crown, each of which comprises a rim that facilitates installation of a liner. In one or more embodiments, the rim comprises an aperture that is closed at both ends and extends horizontally across a convex portion of the rim below the mouth of the receptacle or receptacle-crown. For the receptacle embodiments, the bag serves as a liner. For receptacle-crown embodiments, the bag hangs from the receptacle-crown, which may be supported by a wall mount, stand, container, or any other suitable support. The second component is either a ring or a lid, each of which fits over the rim of the first component and conceals the edge and border of the bag (i.e., the skirt of the bag). The second component may be separate from the first component or it may be attached to the first component by a hinge, including but not limited to a living hinge. The bin assembly of the present disclosure may be used for collecting various materials or items (such as, for example, waste, recycling, composting, items for destruction, items for reuse, items for repurposing, items for donation or sale, and items for cleaning, such as laundry).

Figure 1A:
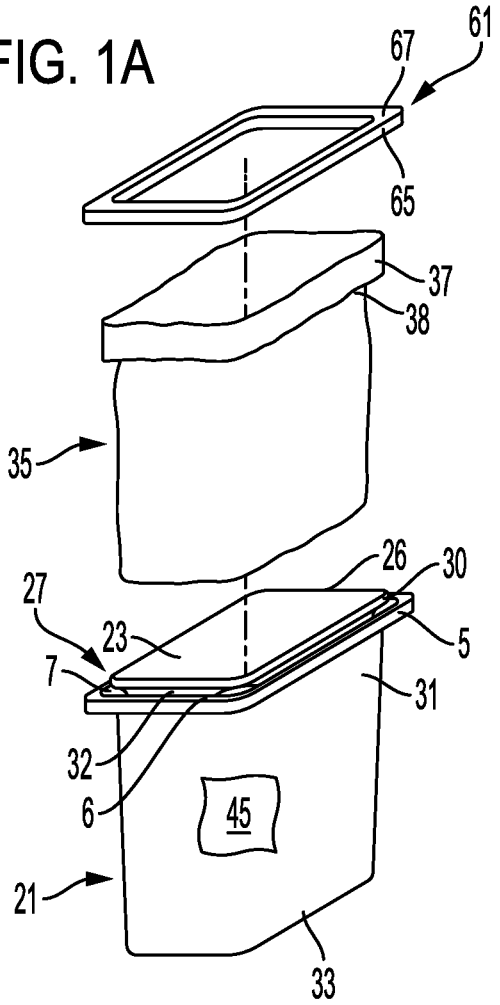
FIG. 1A is a perspective view of the first embodiment, a bin assembly which comprises a ring and a receptacle and is shown with a not-yet-installed bag liner.

With reference now to FIGS. 1A through 1I, the first embodiment of the bin assembly comprises a receptacle 21 and a ring 61. FIG. 1A. The mouth 23 of the receptacle 21 of the first embodiment is essentially rectangular as is the ring 61. FIG. 1A. The ring 61, which comprises a vertical face 65 and a cap 67, fits over the rim 27 of the receptacle 21. At each of the four corners of the rim 27 of the receptacle 21, an aperture 7 facilitates installing a bag (liner) 35. FIG. 1A. In the illustrated embodiment, the aperture 7 is closed at both ends and extends horizontally across a convex portion of the rim 27 below the mouth 23 of the receptacle 21. The bag (liner) 35, which is attached to the bin assembly, includes an edge 38 and border 37. FIG. 1A.

Figure 1B:
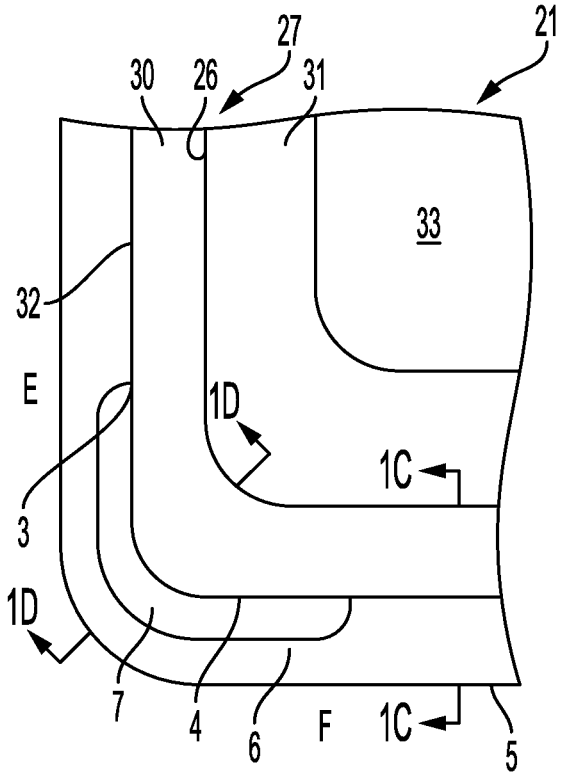
FIG. 1B is a top view of a corner area of the receptacle of the first embodiment.

As shown in FIGS. 1A and 1B, the receptacle 21 includes a base 33 and an interior space (e.g., a chamber) 45 which is surrounded by a wall 31. At one end, the wall 31 joins the base 33 and, at the other end, the wall 31 joins the crest 26 which surrounds the mouth 23. The rim 27 starts at the crest 26 and extends outward from mouth 23. While the base 33, mouth 23, and rim 27 of the first embodiment are essentially rectangular, each of the four corners of the base 33, mouth 23, and rim 27 is rounded.

Figure 1C:
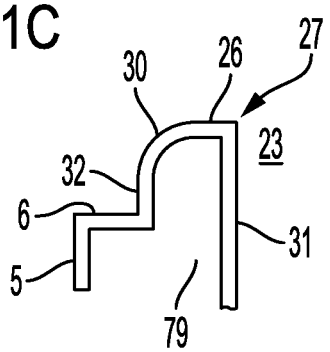
FIG. 1C is a cross section of a portion of the corner area of the receptacle of the first embodiment.

As further shown in FIGS. 1B and 1C, starting with the crest 26 and extending outward, the rim 27 comprises a curved lip 30 which curves downward from the crest 26 and, upon turning, vertical joins the fall 32 which extends vertically downward and joins the guide 6. The guide 6 provides a horizontal surface to guide the installation of a bag 35. FIGS. 1A and 1C. From the fall 32, the guide 6 extends outward horizontally and joins the side 5, which like the fall 32, extends vertically downward. The rim 27 and the wall 31 form a channel 79 which, apart from facilitating grasping and lifting the receptacle 21, facilitates the installation of the bag (liner) 35. FIGS. 1A through 1I.

Figure 1D:
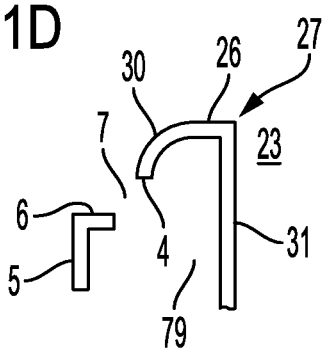
FIG. 1D is a cross section of another portion of the corner area of the receptacle of the first embodiment.

In the areas of each of the four rounded corners, the rim 27 comprises an aperture 7 to the channel 79. FIGS. 1A, 1B and 1D. Here, the curved lip 30 terminates at the brink 4. FIGS. 1B and 1D. Beneath the brink 4, the aperture 7 extends both vertically and horizontally so that, on the outside of the aperture 7, the guide 6 is narrower than as shown in FIG. 1C. FIGS. 1B, 1C and 1D. In the area of each of the four rounded corners, as elsewhere, the guide 6 joins the side 5. FIGS. 1B, 1C and 1D.

Figure 1E:
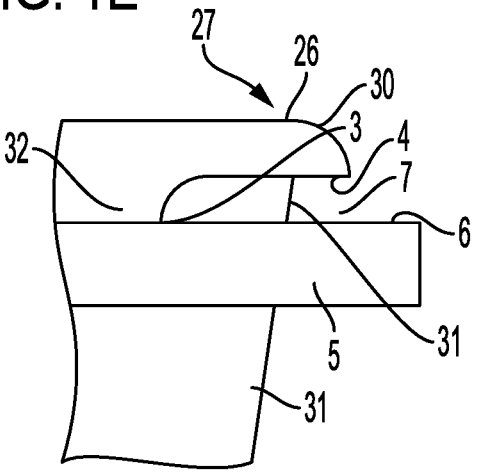
FIG. 1E depicts a side view of a portion of the corner area of the receptacle of the first embodiment.
Figure 1F:
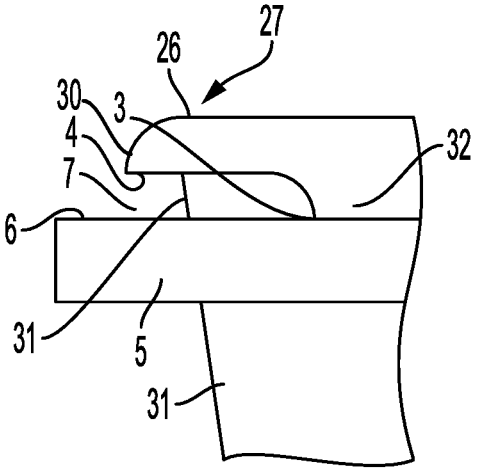
FIG. 1F depicts a side view of another portion of the corner area of the receptacle of the first embodiment.
Figure 1G:
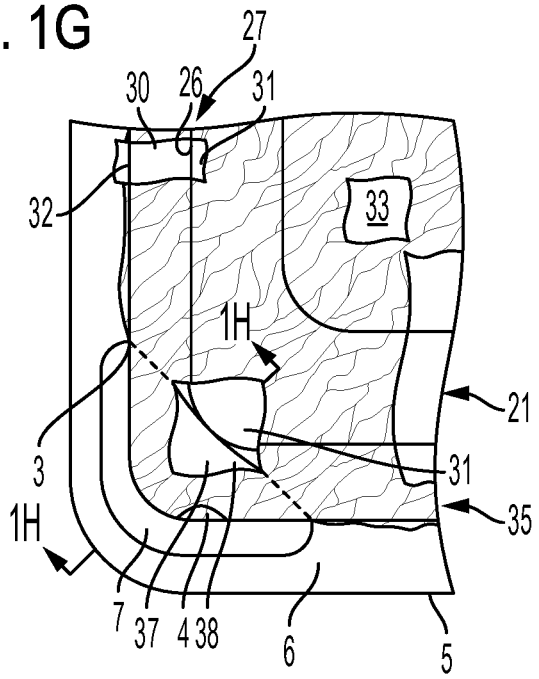
FIG. 1G is top view the corner area of the receptacle of the first embodiment with a bag liner installed in the corner area.

The aperture 7 extends around the entirety of each corner and into a portion of the adjoining straight sides. FIG. 1B. While thus extending beyond the corner itself, each aperture 7 is convex and permits the insertion and "catching" of a portion of the bag 35. FIGS. 1B and 1G. As shown in side views of the aperture 7 depicted in FIG. 1B, at each side ("E" and "F") the brink 4 bends downward and the aperture 7 terminates at the junction 3 adjacent to the vertical fall 32 and the horizontal guide 6. FIGS. 1B, 1E and 1F.

Figure 1H:
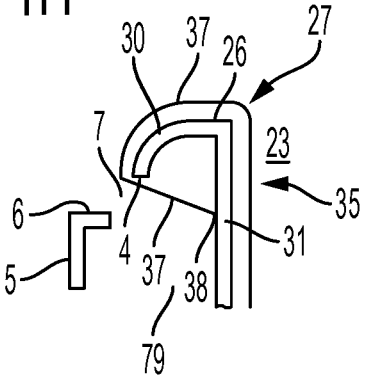
FIG. 1H is a cross section of a portion of a corner of the receptacle of the first embodiment with a bag liner installed at the corner.
Figure 1I:
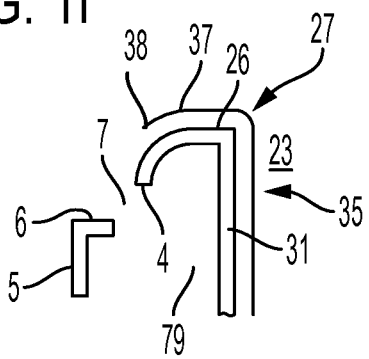
FIG. 1I is a cross section of a portion of another corner of the receptacle of the first embodiment with a bag liner in the process of being installed at a corner.

As shown in FIGS. 1G and 1H, where the bag (liner) 35 has been installed in the corner area of the receptacle 21, the rim 27 allows the edge 38 and border 37 to fit under the brink 4 through the length of the aperture 7. Within the channel 79, the depth of the insertion of the bag 35 is limited by the wall 31. FIGS. 1G and 1H. As shown in FIG. 1G and 1H, at either side of the aperture 7, the fall 32 prevents the bag (liner) 35 from entering the channel 79.

The need for a bag (liner) 35 in the receptacle 21 depends on the contents and use of the receptacle 21. To install a bag (liner) 35 in the rim 27, the installer may rely on the four corners to locate the four apertures 7. FIGS. 1A and 1B. Although installation methods may differ, the following is one possible method. After placing the bag (liner) 35 so that it rests on the base 33, loop the edge 38 and border 37 over any one corner's crest 26 and curved lip 30, pull the edge 38 and border 37 across the upper surface of the guide 6, under the brink 4, and into the vertical portion of aperture 7 of the first corner. See FIGS. 1A, 1G and 1H. With the bag (liner) 35 within the aperture 7 of the first corner, pull the edge 38 and border 37 taut through this aperture and the length of the two adjacent sides and into the next two apertures 7. See FIG. 1A. Finally, slide the remaining edge 38 and border 37 over the final corner's crests 26 and curved lip 30 and into the final aperture 7. See FIG. 1G. For all appropriately sized bags 35, the edge 38 and border 37 may be installed in the first three corners without stretching the receptacle bag 35. However, on the one hand, if the bag 35 the perimeter of the edge 38 is too short, or close to too short, installing the receptacle bag 35 at the fourth corner may not be possible or may require pushing and perhaps stretching the edge 38 and border 37, over the curved lip 30 and into the aperture 7. See FIG. 1I. On the other hand, if the perimeter of the edge 38 is so large that the insertion of the bag (liner) 35 in all four corners fails to secure the bag (liner) 35, the bag (liner) 35 will need to be otherwise secured. Further, any excess edge 38 or border 37 that extends beyond the exterior edge of the rim 27 should be brought within the rim 27 before fitting the ring 61 to the receptacle 21. Regardless of whether a bag (liner) 35 is installed in receptacle 21, the ring 61 fits over the rim 27 of the receptacle 21.

Figure 2:
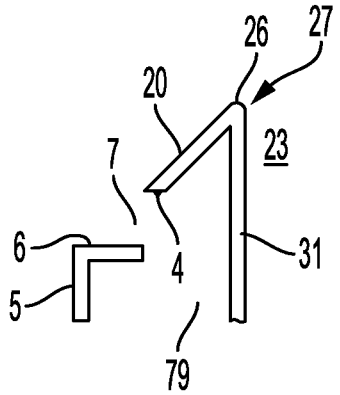
FIG. 2 is a cross section of a corner of the receptacle of the second embodiment of the bin assembly.

The second embodiment of the bin assembly is identical to the first embodiment except that, as shown in FIG. 2, in lieu of the first embodiment's curved lip 30, the second embodiment has an oblique lip 20 and, in the four corner areas, the guide 6 extends the full distance from the side 5 to the vertical extension of the aperture 7. Compare FIG. 2 with FIG. 1D. A receptacle bag (liner) 35 is installed in the second embodiment in essentially the same manner that it is installed in the first embodiment. Regardless of whether a bag (liner) 35 is installed in receptacle 21, the ring 61 (not shown) fits over the rim 27 of the receptacle 21.

Figure 3A:
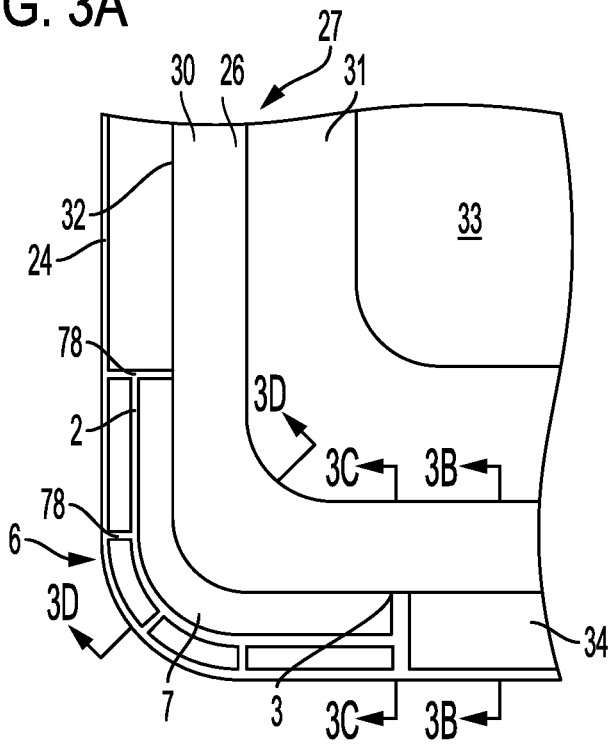
FIG. 3A is a top view of a corner area of the receptacle of the third embodiment of the bin assembly.
Figure 3B:
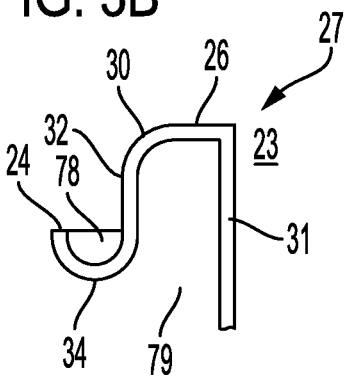
FIG. 3B is a cross section of a portion of the receptacle of the third embodiment.

The third embodiment of the bin assembly, shown in FIGS. 3A through 3D, comprises a receptacle 21 and a ring 61 (unshown). As in the first embodiment, the mouth 23 of the receptacle 21 is essentially rectangular as is the ring 61. See FIG. 1A. The rim 27 of the receptacle 21, as in the first embodiment, extends outward from the mouth 23 of a receptacle 21. Compare FIG. 3A with FIG. 1B. However, in the third embodiment the fall 32 joins a trough 34 that turns upward and terminates at the brim 24. FIG. 3B.

Figure 3C:
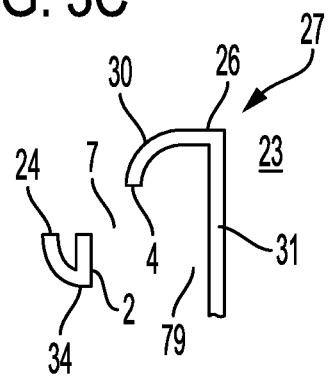
FIG. 3C is a cross section of a portion of a corner area of the receptacle of the third embodiment.
Figure 3D:
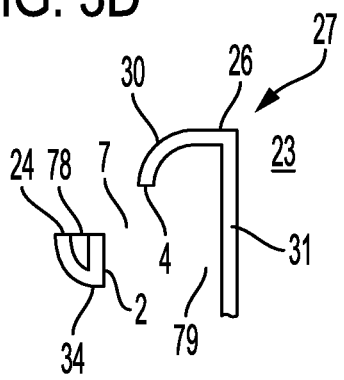
FIG. 3D is another cross section of the corner area of the receptacle of the third embodiment.

The aperture 7 is again located at each of the four corner areas of the rim 27. Again, the apertures 7 in the illustrated embodiment are closed at both ends and extend horizontally across convex portions of the rim 27 below the mouth 23 of the receptacle 21. The guide 6 is again a horizontal surface but, apart from the corner areas, includes only the brim 24. FIGS. 3A and 3B. In the corner areas, the guide 6 includes the brim 24, the top surfaces of the truncator 2 (which truncates the trough 34), and the top surfaces of the ribs 78 that border and transect the truncated trough 34. FIGS. 3A, 3C and 3D.

A receptacle bag (liner) 35 is installed in the third embodiment in the same manner that it is installed in the first and second embodiments. Regardless of whether a bag (liner) 35 is installed in receptacle 21, the ring 61 (not shown) fits over the rim 27 of the receptacle 21.

Figure 4A:
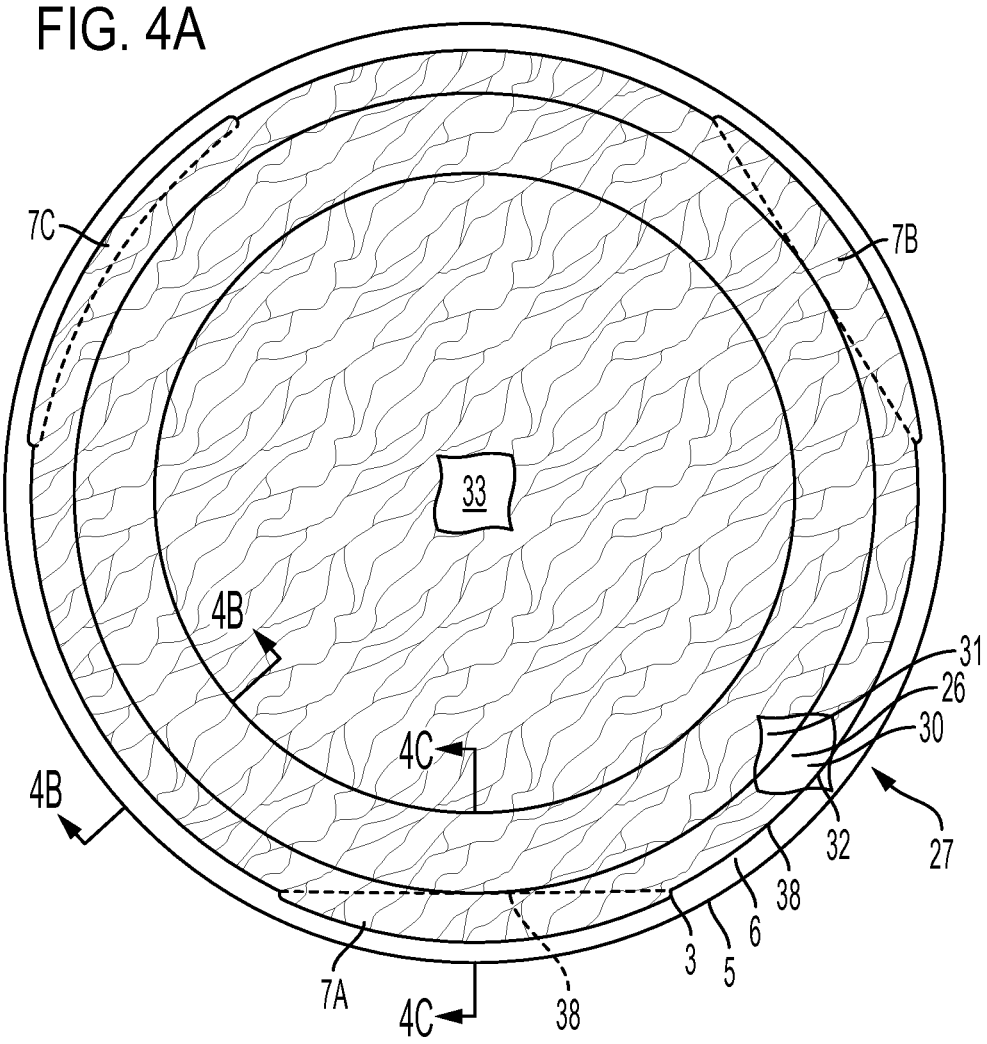
FIG. 4A is a top view of the receptacle of the fourth embodiment of the bin assembly, shown with a bag liner installed in the receptacle.
Figure 4B:
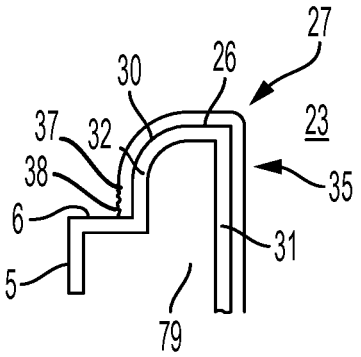
FIG. 4B is a cross section of a portion of the receptacle of the fourth embodiment, shown with a bag liner installed in the receptacle.
Figure 4C:
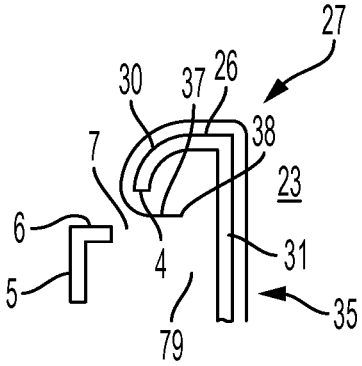
FIG. 4C depicts another cross section of a portion of the receptacle of the fourth embodiment, shown with a bag liner installed in the receptacle.

The fourth embodiment of the bin assembly comprises a receptacle 21 which is shown, along with an installed bag 35, in FIGS. 4A through 4C, and a ring 61 (unshown). The base 33 and mouth 23 of the receptacle 21 are circular. FIG. 4A. Similarly the ring 61 (unshown) is circular and fits over the annular rim 27 of the receptacle 21. See FIG. 4A. Within the rim 27, the crest 26 and curved lip 30 are each annular and surround the mouth 23. FIGS. 4A, 4B, and 4C.

In the fourth embodiment, there are three apertures 7, each found at intervals on the continuously convex rim 27. Again, the apertures 7 are closed at both ends and extend horizontally across convex portions of the rim 1 below the mouth 23 of the receptacle 21. In the intervals between the apertures 7, the curved lip 30 joins the fall 32 which in turn joins the outwardly extending guide 6. FIGS. 4A and 4B; compare FIGS. 1B and 1C. At the apertures 7, the guide 6 narrows and the aperture 7 is both vertical and horizontal. FIGS. 4A and 4C. As in the first embodiment, toward each end of the apertures 7, the brink 4 bends downward and the guide 6 expands in width so that the aperture 7, at junction 3, is bordered by the vertical fall 32 and the horizontal guide 6. FIG. 4A; see FIGS. 1B, 1E, 1F. At all points on the exterior perimeter of the guide 6, the guide 6 joins the annular side 5, which extends downward. FIGS. 4A, 4B and 4C.

In FIGS. 4A, 4B and 4C, the fourth embodiment is shown with an installed receptacle bag (liner) 35. The installation of the receptacle bag in the fourth embodiment may proceed in essentially the same as in the first embodiment, but because the fourth embodiment has no corners, the installer, if looking down at the receptacle 21 and the rim 27, may rely on the narrowed guides 6 to locate the apertures 7. FIG. 4A. As in the first embodiment, the insertion of the edge 38 and border 37 in the final aperture 7 (here identified as 7C) and any further steps to secure the bag (liner) 35 may depend upon the relative length of the perimeter of the edge 38 of the bag (liner) 35. FIGS. 4A through 4C; see FIGS. 1G, 1H and 1I and Detailed Description above. Regardless of whether a bag (liner) 35 is installed in receptacle 21, the circular ring 61 (not shown) fits over the rim 27 of the receptacle 21.

Figure 5A:
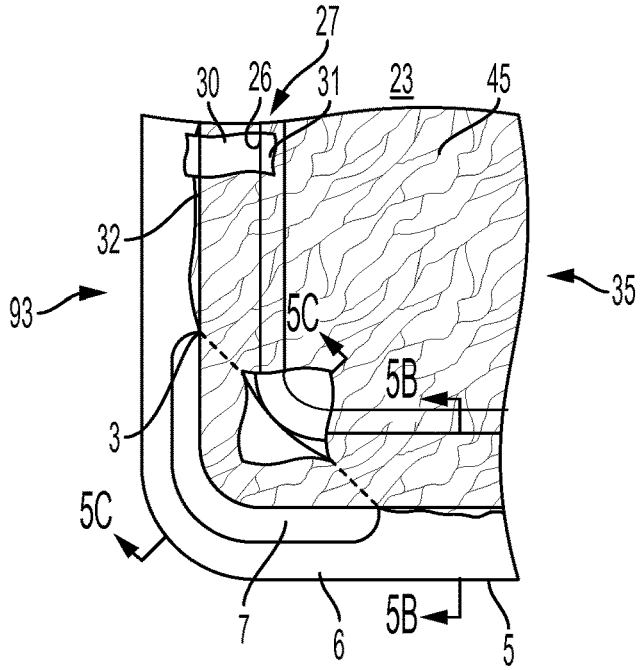
FIG. 5A is a top view of a corner area of the receptacle-crown of the fifth embodiment, a bin assembly comprised of a ring and a receptacle-crown, and is shown with a bag installed in the receptacle-crown.
Figure 5B:
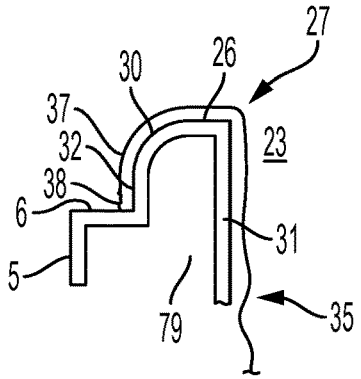
FIG. 5B is a cross section of a portion of the receptacle-crown of the fifth embodiment, shown with a bag installed in the receptacle-crown.
Figure 5C:
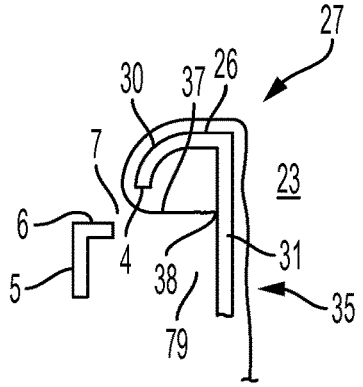
FIG. 5C is a cross section of a corner of the receptacle-crown of the fifth embodiment, shown with a bag installed in the receptacle-crown.

The fifth embodiment of the bin assembly, shown in FIGS. 5A through 5C with an installed receptacle bag 35, is essentially the same as the bin assembly of the first embodiment but a receptacle-crown 93 has been substituted for the receptacle 21. While the receptacle 21 of the first embodiment has a wall 31 that extends downward to a base 33, the wall 31 of the fifth embodiment extends downward only to the elevation of the bottom edge of the side 5. Compare FIGS. 1A through 1D with FIGS. 5A through 5C. Further, while the rim 27 of the receptacle-crown 93 of the fifth embodiment permits the installing of a bag 35 in the same manner as the rim 27 of the receptacle 21 of the first embodiment (see FIGS. 1G, 1H and 1I and Detailed Description above), the bag 35 attached to the receptacle-crown 93 of the fifth embodiment does not line a chamber 45 but instead lines an interior space defined by the wall 31 and, with the structural help of the receptacle-crown 93, forms a chamber 45 of its own. Compare FIG. 5A with FIGS. 1A and 1B. Thus, in using the fifth embodiment (or any embodiment in which the first component is a receptacle-crown 93) the bag 35 must be chosen for toughness and strength in accordance with its contents and use. After the bag 35 is installed, the ring 61 (not shown) fits over the rim 27 of the receptacle 21. See FIG. 1A.

The fifth bin assembly and the attached bag 35, as described above, may be supported by a wall mount, a stand, a container or other support (all unshown) and each may support a single bin assembly, or multiple bin assemblies, of the fifth embodiment.

Figure 6:
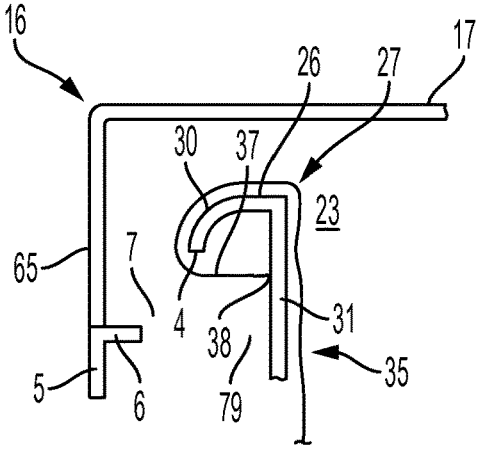
FIG. 6 is a cross section of a portion of the sixth embodiment, a bin assembly comprising a ring and either a receptacle or a receptacle-crown, shown with a bag that has been installed in the receptacle or the receptacle-crown.

The sixth embodiment of the bin assembly comprises a lid 16 that fits over the rim 27 of either a receptacle 21 or a receptacle-crown 93, shown in FIG. 6 with an installed bag 35. The lid 16 comprises a cover 17 which covers all or a part of the mouth 23. FIG. 6. If the first component is a rectangular receptacle 21, the sixth embodiment would resemble the first embodiment but the lid 16 has been substituted for the ring 61. FIG. 6; see FIGS. 1A and 1H and Detailed Description above. If the first component is a circular receptacle 21, the sixth embodiment would resemble the fourth embodiment but the lid 16 has been substituted for the ring 61. FIG. 6; see FIGS. 4A and 4C and Detailed Description above. If the second component is a rectangular receptacle-crown 93, the sixth embodiment would resemble the fifth embodiment but the lid 16 has been substituted for the ring 61. FIG. 6; see FIGS. 1A, 5A, 5C and Detailed Description above. If the second component is a circular receptacle-crown 93, the sixth embodiment would resemble both the fourth and fifth embodiments in that the first component is circular (as in the fourth embodiment) and a receptacle-crown 93 (as in the fifth embodiment) but the lid 16 has been substituted for the ring 61. FIG. 6; see FIGS. 4A through 4C, 5A through 5 C, and Detailed Description above.

Figure 7:
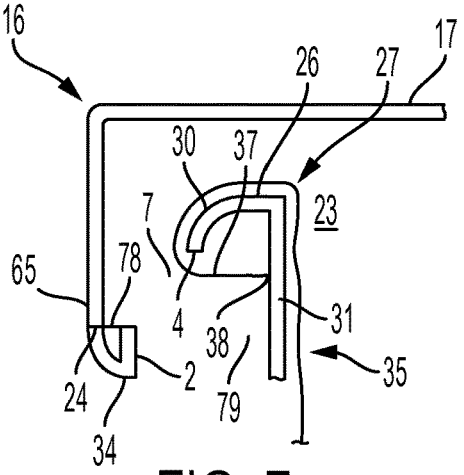
FIG. 7 is a cross section of a portion of the sixth embodiment, an assembly comprising a lid and either a receptacle or a receptacle-crown, shown with a bag that has been installed in the receptacle or the receptacle-crown.

The seventh embodiment of the bin assembly comprises a lid 16 that fits over the rim 27 of either a receptacle 21 or a receptacle-crown 93, shown in FIG. 7 with an installed bag 35. The lid 16 comprises a cover 17 which covers all or a part of the mouth 23. FIG. 7. If the first component is a rectangular receptacle 21, the seventh embodiment would resemble the third embodiment but the lid 16 has been substituted for the ring 61. FIG. 7; see FIGS. 3A and 3D and Detailed Description above. If the first component is a circular receptacle 21, the seventh embodiment would resemble both the third and fourth embodiments in that the first component is a receptacle 21 comprising a trough 34 (as in the third embodiment) and circular (as in the fourth embodiment) but the lid 16 has been substituted for the ring 61. FIG. 7; see FIGS. 3A, 3D and 4A and Detailed Description above. If the first component is a rectangular receptacle-crown 93, the seventh embodiment would resemble the third and fifth embodiments in that the first component is rectangular and comprises a trough 34 (as in the third embodiment) and is a receptacle-crown (as in the fifth embodiment) but the lid 16 has been substituted for the ring 61. FIG. 7; see FIGS. 3A, 3D and 5A and Detailed Description above. If the first component is a circular receptacle-crown 93, the seventh embodiment would resemble the third, fourth and fifth embodiments in that the first component comprises a trough 34 (as in the third embodiment) is circular (as in the fourth embodiment) and is a receptacle-crown 93 (as in the fifth embodiment) but the lid 16 has been substituted for the ring 61. FIG. 7; see FIGS. 3A, 3D, 4A, 5A and Detailed Description above.

Figure 8A:
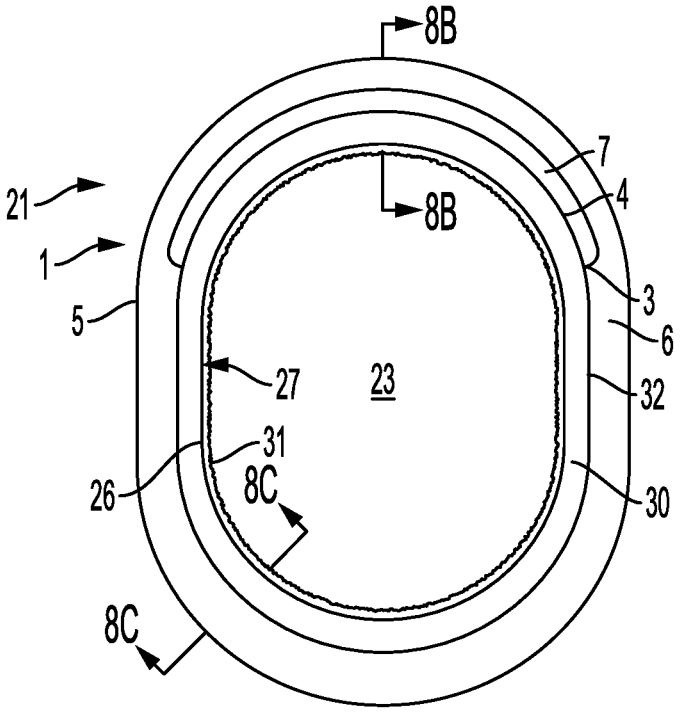
FIG. 8A is a top view of a portion of either the receptacle or the receptacle-crown of the eighth embodiment, a bin assembly comprised, on the one hand, of either a receptacle or a receptacle-crown and, on the other hand, either a ring or a lid.
Figure 8B:
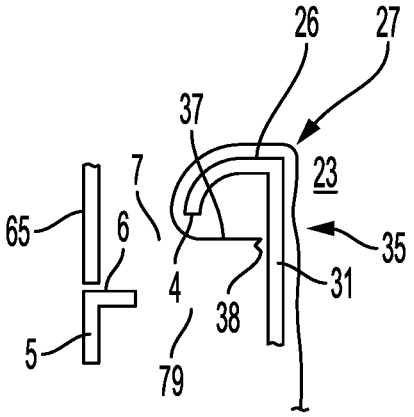
FIG. 8B is a cross section of a portion of either the receptacle or the receptacle-crown and either the ring or the lid of the eighth embodiment, shown with a bag that has been installed in the receptacle or the receptacle-crown.
Figure 8C:
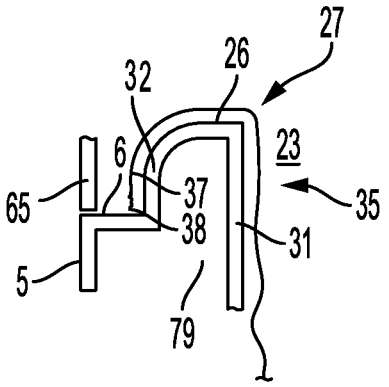
FIG. 8C depicts another cross section of a portion of either the receptacle or the receptacle-crown and either the ring or the lid of the eighth embodiment, shown with a bag that has been installed in the receptacle or the receptacle-crown.

The eighth embodiment of the bin assembly, shown in FIGS. 8A through 8C, comprises either a receptacle 21 or a receptacle-crown 93 and either a ring 61 or a lid 16 and is shown in FIGS. 8B and 8C with bag 35 installed in the rim 27 of the either the receptacle 21 or the receptacle-crown 93. Neither the ring 61 nor the lid 16 is shown in FIG. 8A, but a portion of the vertical face 65 of either the ring 61 or the lid 16 is shown in both FIG. 8B and FIG. 8C. Compare FIG. 1A (ring 61) with FIG. 6 (lid 16) and FIG. 7 (lid 16). The mouth 23 and rim 27 of this first component are oval. FIG. 8A. A single aperture 7 extends through one of the two convex ends of the oval rim 27. FIGS. 8A and 8B. The aperture 7 is closed at both ends and extends horizontally across a convex portion of the rim 27 below the mouth 23 of the receptacle 21. The opposing end of the rim 27 lacks any aperture 7. FIGS. 8A and 8 C.

If the first component of the eighth embodiment of the bin assembly is a receptacle 21, the bag 35 shown in FIGS. 8A and 8B would serves as a liner. If the first component is a receptacle-crown 93, the bag 35 would form a chamber 45 of its own and must, therefore, be chosen for toughness and strength in accordance with its contents and use. Looking down on the receptacle 21 or the receptacle-crown 93, the installer can see the horizontal portion of aperture 7 from above (FIG. 8A) and thus identify that end as the end at which to begin installation of the bag 35. Looping the edge 38 and border 37 of the bag 35 over the crest 26 and curved lip 30, the installer pulls the edge 38 and border 37 of the bag 35 across the surface of the guide 6, under the brink 4, and thus into the vertical portion of the aperture 7. FIGS. 8A and 8B. The installer then pulls the edge 38 and border 37 taut across the length of the aperture 7, across each of the adjacent sides, and onto the fall 32 opposite the aperture 7. FIGS. 8A and 8C. Opposite the aperture 7, the installer cinches the bag 35 against the fall 32 and secures the bag 35 and any excess edge 38 and border 37.

After installation of any bag 35, the ring 61 or lid 16 of the eighth embodiment may be fit to the rim 27 of the receptacle 21 or receptacle-crown 93. If the first component is a receptacle 21, the ring 61 or lid 16 fits over the rim 27 of the receptacle 21 regardless of whether a bag 35 has been installed.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "front," "back," and similar terms have been used herein to describe a spatial relationship of one element to another, it is understood that these terms are intended to encompass different orientations of the various elements and components of the invention in addition to the orientation depicted in the figures. Additionally, as used herein, the term "essentially" and similar terms are used as terms of approximation and not as terms of degree, and are intended to account for the inherent deviations in measured or calculated values that would be recognized by those of ordinary skill in the art.

What is claimed is:

1. A bin assembly comprising:

one of a receptacle and a receptacle-crown comprising:

at least one wall defining an interior space;

a mouth defined by an upper end of the at least one wall, the mouth in communication with the interior space;

a rim extending outward and downward from the mouth, the rim comprising at least one horizontally convex portion below the mouth; and an aperture in the at least one horizontally convex portion of the rim, the aperture being configured to receive an edge portion of a liner, wherein the aperture is enclosed at least partially on all sides by portions of the rim, wherein the aperture is unobstructed, and wherein the aperture is not in communication with the interior space.

2. The bin assembly of claim 1, wherein the aperture is elongated horizontally.

3. The bin assembly of claim 1, further comprising a channel defined between a lower surface of the rim and an outer surface of the at least one wall, and wherein the aperture opens to the channel.

4. The bin assembly of claim 1, further comprising one of a ring and a lid configured to fit over the rim of the one of the receptacle and the receptacle-crown.

5. The bin assembly of claim 1, wherein the rim comprises a corner, and wherein the at least one horizontally convex portion is at the corner.

6. The bin assembly of claim 5, wherein the rim further comprises:

a first straight side at a first end of the corner; and a second straight side at a second end of the corner opposite the first end, and wherein the aperture extends entirely around the corner and into portions of the first and second straight sides.

7. The bin assembly of claim 1, wherein the rim is rectangular.

8. The bin assembly of claim 1, wherein the rim is annular.

9. The bin assembly of claim 1, wherein the rim is oval.

10. The bin assembly of claim 1, wherein the one of the receptacle and the receptacle-crown comprises the receptacle, and wherein the receptacle comprises a base and the at least one wall extends upward from the base.

11. The bin assembly of claim 1, wherein the one of the receptacle and the receptacle-crown comprises the receptacle-crown.

12. A bin assembly comprising:

one of a receptacle and a receptacle-crown comprising:

at least one wall defining an interior space;

a mouth defined by an upper end of the at least one wall, the mouth in communication with the interior space;

a rim extending outward and downward from the mouth, the rim comprising:

at least one horizontally convex portion below the mouth;

a lip;

a fall extending downward from a lower end of the lip; and a guide extending outward from a lower end of the fall; and an aperture in the at least one horizontally convex portion of the rim, the aperture being configured to receive an edge portion of a liner, wherein the aperture is enclosed at least partially on all sides by portions of the rim.

13. The bin assembly of claim 12, wherein the aperture is in a portion of the fall.

14. The bin assembly of claim 12, wherein the guide is adjacent to the aperture.

15. A bin assembly comprising:

one of a receptacle and a receptacle-crown comprising:

at least one wall defining an interior space;

a mouth defined by an upper end of the at least one wall, the mouth in communication with the interior space;

a rim extending outward and downward from the mouth, the rim comprising:

at least one horizontally convex portion below the mouth;

a lip;

a fall extending downward from a lower end of the lip; and at least a portion of a trough extending outward and downward from a lower end of the fall; and an aperture in the at least one horizontally convex portion of the rim, the aperture being configured to receive an edge portion of a liner, wherein the aperture is enclosed at least partially on all sides by portions of the rim, wherein the aperture is in a portion of the fall.

16. The bin assembly of claim 15, wherein the rim further comprises:

a plurality of convex apertures, and at least a portion of a trough.

* * * * *